United States Patent [19]

Ching

[11] Patent Number: 4,735,132

[45] Date of Patent: Apr. 5, 1988

[54] INSULATING ENCLOSURE FOR RECESSED CEILING EXHAUST FAN

[76] Inventor: Kam T. Ching, 2809 Peabody Rd., Montgomery, Ala. 36116

[21] Appl. No.: 929,506

[22] Filed: Nov. 12, 1986

[51] Int. Cl.[4] ..... F23L 13/00; F04D 25/14

[52] U.S. Cl. ..... 98/119; 49/463

[58] Field of Search ..... 98/42.07, 42.1, 119; 49/463

[56] References Cited

U.S. PATENT DOCUMENTS

| | | | |
|---|---|---|---|
| 2,568,355 | 9/1951 | Morrison | 98/116 |
| 2,722,272 | 11/1955 | Sprinkle | 49/463 |
| 2,799,890 | 7/1957 | Stavich | 49/463 |
| 2,821,895 | 2/1958 | Allabaugh | 98/37 |
| 3,232,205 | 2/1966 | Bumstead | 98/42.16 |
| 3,792,511 | 2/1974 | Hallas | 49/463 |
| 3,858,355 | 1/1975 | Root | 49/463 |
| 3,964,377 | 6/1976 | Chapman | 98/121.2 |
| 4,287,815 | 9/1981 | Henderson | 98/42.07 |
| 4,469,018 | 9/1984 | Taulman | 98/114 |
| 4,483,102 | 11/1984 | Edwards | 49/465 |
| 4,502,368 | 3/1985 | Hempel | 98/119 |
| 4,520,715 | 6/1985 | Coomes et al. | 98/119 |

*Primary Examiner*—Larry I. Schwarz

*Attorney, Agent, or Firm*—George J. Porter

[57] ABSTRACT

An insulating enclosure for recessed ceiling exhaust fan is disclosed. The insulating enclosure (10) comprises a rectangular frame (22) attached to the frame (24) of the lower panel (18). The frame (22) of the insulating enclosure (10) fits snugly against the ceiling (16). The insulating enclosure (10) further comprises a removable insulating panel (26) which fits snugly into the rectangular frame (22). One side of the insulating panel (26) has a lip (28) which fits into a channel (30) on the inside of one side of frame (22). Thus, lip (28) may be inserted into channel (30) so as to hold up one side of panel (26) while the other side is pushed into place in its frame (22). After panel (26) is in position it will be held up on one side by lip (28) and on the other side by latch (32).

6 Claims, 1 Drawing Sheet

INSULATING ENCLOSURE FOR RECESSED CEILING EXHAUST FAN

TECHNICAL FIELD

The present invention relates to an insulating enclosure which fits over and covers the opening made in a ceiling for a ceiling exhaust fan. The enclosure is intended for use only when the ceiling fan is not in use.

BACKGROUND OF THE INVENTION

Enclosures which fit over openings for ceiling fans and other vent type openings around the home are well known in the prior art. A number of these devices have been developed and used in the past, but in general they have not been completely accepted by the public because of deficiencies which the present invention seeks to overcome. Many devices previously developed for this purpose are relatively expensive, unattractive, inefficient, and complex to manufacture or to mount. One such enclosure is shown in U.S. Pat. No. 4,520,715 to Coomes et al. This patent shows a simple cover apparatus for a room air register. This device uses L-shaped hooks to hold a rectangular shaped insulating pad over a register. The device has no sealing around its outside periphery, is quite unattractive, and is held in place in some cases by conventional adhesive material which of course would be insufficient to hold a massive enclosure as is normally used for closing and insulating ceiling fan openings.

A similar air vent cover is disclosed in U.S. Pat. No. 4,502,368 to Hempel. This device utilizes slotted holes and screws to attach a cover to an air vent. Again this device does not teach a fastening means which is suitable for convenient installation and holding a massive cover of the type used for ceiling fan openings.

U.S. Pat. No. 2,568,355 to Morrison illustrates a ventilation shutter which is not intended to insulate but simply to close a shutter opening, comprises complex, metal framework, hinges, a tie bar, and latching means and is in general quite complicated, expensive to manufacture and is not adaptable for use in closing a ceiling fan opening.

Another closure device is illustrated in U.S. Pat. No. 4,469,018 to Taulman. This patent discloses a closure for foundation vents which, as the other cited patents, is designed for a small closure. It is not suitable to meet the requirements for closing a large ceiling fan opening.

U.S. Pat. No. 2,821,895 to Allabaugh, as in previously cited patents, provides a closure for a ventilation opening which is quite different than the subject invention in that it employs a series of spring-loaded hooks for holding a cover in place over an opening in a house foundation. The device shows none of the features of the present invention.

U.S. Pat. Nos. 4,483,102 and 4,287,815 to Edwards and Henderson, respectively, show closure devices which are intended for use with ceiling fan openings or the like. However, in each case, the devices require complex and expensive extrustion or fabrication of the framework and hinge assemblies used therein, and do not provide the surface contact required for complete sealing of a fan opening. The Edwards patent, for example, requires a complex series of seals and framework to accomplish its function and provides a rather unattractive enclosure as does the cover assembly of Henderson which uses a plurality of U-shaped spring members to retain the enclosure in place. It is apparent that such use of several parts as in Henderson is quite disadvantageous from the standpoint of its complexity of mounting as well as the number of elements which the homeowner must retain when storing the device.

In view of the foregoing discussion, it will be apparent that existing closures do not provide a truly effective insulator which is simple to install yet inexpensive and attractive. Moreover, these prior art devices do not provide an insulating enclosure for use with a typical recessed ceiling exhaust fan. These fans are not used during winter when the heating system is in use or in summer when the air conditioner is in use. Thus it will be appreciated that during changeable weather an enclosure may be installed and removed quite often.

It is therefore an object of this invention to provide an effective insulating enclosure for a recessed ceiling exhaust fan which is simple to install and yet inexpensive.

It is a further object of this invention to provide an insulating enclosure for recessed ceiling exhaust fans which is rigidly attached to the ceiling over the existing framework of the typical ceiling fan assembly.

Yet another object of this invention is to provide an insulating enclosure for a recessed ceiling fan which utilizes a surrounding attractive rectangular or square frame which is adapted to the thickness required for an insulating panel which is to be placed therein.

Yet another object of this invention is to provide a device which may be installed one end at a time and swung into place so as to be easily installed or removed by one person.

Still a further object of this invention is to provide a cooperating sealing system between an insulating panel and its framework which provides the maximum sealing, and insulting, surface around the periphery of the panel.

SUMMARY OF THE INVENTION

The present invention is an insulating enclosure which fits over and covers the framework of an exhaust ceiling fan. Such an enclosure must provide an efficient insulation during use which normally would be during periods of extreme temperatures whether hot or cold. These fans, sometimes referred to as "whole-house" fans are usually mounted in the ceiling of a center hall. During periods when neither heating nor air conditioning systems are in use, they pull air in through the open windows of all rooms in the house and then exhaust air from the house to the attic which is ventilated to the outside atmosphere.

The invention comprises an insulating enclosure which includes a rectangular or square frame which is attached to the framework of a ceiling fan. The frame fits snugly against the ceiling and covers the fan framework completely. The insulating enclosure comprises a removable insulating panel which fits snugly into its rectangular frame. One side of the insulating panel has a lip which slips into a channel on the inside of one side of the frame. Thus, this lip may be inserted into the channel to hold up one side of the panel while the opposite end of the panel is raised into place within its frame. After being placed in its mounted position the panel will be held on one side by the lip and on the other side by a latch mechanism. The invention also contemplates a variety of sealing surfaces between the insulating panel and its frame, each providing a unique sealing arrangement which is effective for an enclosure of this type.

DETAILED DESCRIPTION OF THE INVENTION

The invention shown generally by numeral 10 was developed because of a need for a simple, efficient insulating enclosure for recessed ceiling fans which is attractive, simple to use and yet inexpensive.

Figure 1:
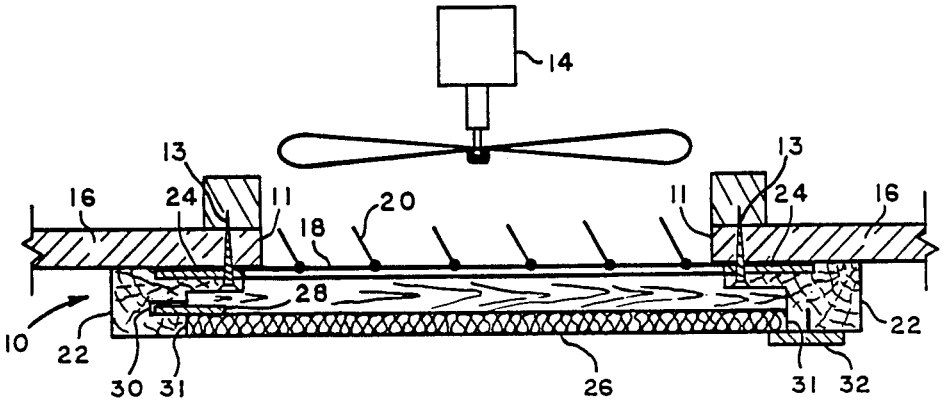
FIG. 1 is an elevational view and partial vertical section with parts broken away for clarity of the fan and insulating enclosure.

As shown in FIG. 1 the enclosure 10 is adapted to cover an opening 11 in a ceiling 16. The fan 14 as shown is typically mounted above a framework and louver grid, or similar vent cover assembly wherein the framework 24 supports the louver assembly 18 and 20, and is attached by screws 13 or other suitable means to the ceiling 16. The louvers 20 are supported by a louver panel 18 attached to framework 24. In order to support the insulating enclosure panel, frame 22 is attached to means of screws 13 or other adequate attachment means. The inner vertical surface of frame 22 fits snugly against framework 24. One side of frame 22 is provided with a channel 30 which may extend the full length of one side of the frame or only a small portion thereof if desired. An insulating panel 26 is dimensionsed to fit snugly against a sealing surface 31 within the inner periphery of frame 22. On the end of panel 26 adjacent channel 30 a lip 28 is provided for insertion into the channel 30 whereby the panel may be easily inserted on one end and retained therein by the lip while the free end of the panel is lifted into place. This arrangement provides a means for installation or removal of the panel by one person even when the panel is very large. A latch mechanism 32 of conventional design is attached to the frame 22 for retention of the panel in its final installed position. Additional sealing means such as rubber strips may be placed between the frame 22 and the ceiling 16 or framework 24 if the surfaces of the framework or ceiling are rough or uneven.

Figure 2:
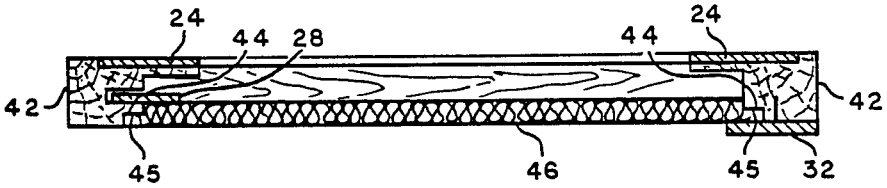
FIG. 2 is an elevational view and partial section with parts broken away for clarity of the insulating enclosure and its framework and illustrating a modified sealing edge between the panel and its frame.

In the arrangement as illustrated in FIG. 2, panel frame 42 is provided with a sealing surface 44 which is formed by a rectangular cutout along its lower inside corner. Similarly a mating surface 45 of the insulating panel 46 is formed by removal of a rectangular section, thus forming the surface 45 which mates snugly with sealing surface 44 of the frame 42 and provides an additional sealing surface area.

Figure 3:
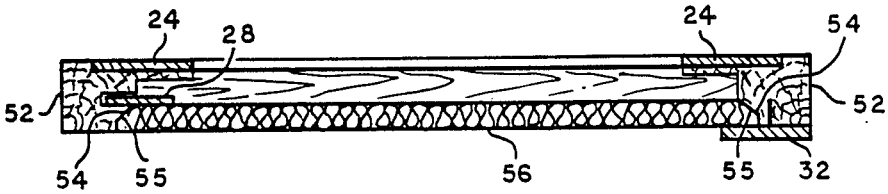
FIG. 3 is an elevational view and partial vertical section with parts broken away for clarity of the insulating enclosure and its panel showing yet another sealing arrangement between the panel and its frame.

In the arrangement as illustrated in FIG. 3, the frame 52 is provided with a sealing surface 54 formed by removal of a diagonal recessed portion around its lower inside corner. Likewise the panel 56 is provided with a mating diagonal surface 55 which provides an even greater and more effective (tighter-fitting) surface area for sealing between the panel and the frame. This arrangement further provides the capability of a greater squeeze pressure being applied between the diagonal surfaces 54 and 55.

While the invention is shown in but three alternative forms, as shown in FIGS. 1, 2 and 3, it will be obvious to those skilled in the art that it is not so limited but is susceptible to various other changes and modifications without departing from the spirit thereof.

I claim:

1. An insulating enclosure assembly for completely enclosing a vent cover assembly covering the opening in a surface, said vent cover assembly including a central grid like structure having a framework therearound, said insulating enclosure assembly comprising:

a frame having an inner upstanding surface and arranged for snug-fitting engagement with the outer peripheral edges of said framework of said vent cover assembly, one end of said frame haing a channel therein;

an insulating panel disposed for snug-fitting engagement with said inner upstanding surface of said frame of said insulating closure assembly, said insulating panel provided with a lip extending from a first end thereof for insertion into said channel; and latch means disposed at a second end of said insulating panel for secured relation of said insulating panel and said frame of said insulating enclosure assembly.

2. An insulating enclosure assembly as set forth in claim 1 wherein the upper surface of said frame of said insulating enclosure assembly is in firm contact with said framework and with the surface having said opening therein.

3. An insulating enclosure assembly as set forth in claim 1 wherein the upper periphery of said panel and the lower periphery of said frame include mating notches so as to form an effective mutisided seal between said panel and said frame.

4. An insulating enclosure assembly as set forth in claim 3 wherein the upper surface of said panel notch and the lower surface of said frame notch are mating diagonal surfaces whereby said mating diagonal surfaces provide an improved and tighter-fitting seal for said enclosure assembly.

5. An enclosure for insulating and sealing a rectangular recessed ceiling fan opening having a surrounding framework attached to the lower face of the ceiling comprising:

a rectangular frame attached to and completely covering the outside of said framework and extending downwardly therefrom, one side of said frame having a longitudinal slot on the inner face thereof;

a rectangular panel adapted to fit snugly within said frame, said panel having a lip on one edge thereof adapted to fit within said longitudinal slot so as to support the edge of said panel, a portion of said panel being larger than the inside periphery of said frame and wherein the upper periphery of said panel and the lower inside periphery of said frame include mating notches so as to form an effective multisided seal between said panel and said frame; and a latch means attached to said frame and adapted to support the edge of said panel opposite the edge supported by said longitudinal slot.

6. An enclosure as set forth in claim 5 wherein the upper surface of said panel notch and the lower surface of said frame notch are mating diagonal surfaces whereby said mating diagonal surfaces provide an improved and tighter-fitting seal for said enclosure.

* * * * *